US011097232B2

(12) United States Patent
Glanville et al.

(10) Patent No.: US 11,097,232 B2
(45) Date of Patent: Aug. 24, 2021

(54) STATIC MIXER WITH CURVED FINS

(71) Applicant: Westfall Manufacturing Company, Bristol, RI (US)

(72) Inventors: Robert W. Glanville, Bristol, RI (US); James M. Daniel, Worcester, MA (US); Kimbal Hall, Princeton, MA (US); Scott A. Olson, Tiverton, RI (US)

(73) Assignee: Westfall Manufacturing Company, Bristol, RI (US)

( * ) Notice: Subject to any disclaimer, the term of this patent is extended or adjusted under 35 U.S.C. 154(b) by 0 days.

(21) Appl. No.: 16/990,094

(22) Filed: Aug. 11, 2020

(65) Prior Publication Data

US 2020/0368701 A1 Nov. 26, 2020

Related U.S. Application Data

(63) Continuation of application No. 16/141,889, filed on Sep. 25, 2018, now Pat. No. 10,737,227.

(51) Int. Cl.
*B01F 5/06* (2006.01)

(52) U.S. Cl.
CPC ..... *B01F 5/0615* (2013.01); *B01F 5/0617* (2013.01); *B01F 2005/0622* (2013.01); *B01F 2005/0636* (2013.01)

(58) Field of Classification Search
CPC ..... B01F 5/0615; B01F 5/0617; B01F 2005/0622; B01F 2005/0636
USPC ..... 366/338
See application file for complete search history.

(56) References Cited

U.S. PATENT DOCUMENTS 5,093,058 A * 3/1992 Harmon ..... B01F 3/0807 239/106
8,322,381 B1 * 12/2012 Glanville ..... B01F 5/0616 138/39
2002/0031046 A1 * 3/2002 Schneider ..... B01F 5/0451 366/181.5
2004/0141413 A1 * 7/2004 Keller ..... B01F 5/064 366/337

* cited by examiner

*Primary Examiner* — Marc C Howell
(74) *Attorney, Agent, or Firm* — McInnes & McLane, LLP

(57) ABSTRACT

A static mixer includes a tubular body having a sidewall with an upstream end, a downstream end opposite the upstream end, and an inner surface. The upstream end has a surface defining an upstream opening into the body. The downstream end has a surface defining a downstream opening exiting the body. The upstream opening, the downstream opening, and inner surface define a passageway through the body for transport of a first fluid therethrough. A primary fin may depend from the inner surface of the body and into the passageway. The primary fin may have a curved fin with a flow surface. A secondary fin may extend into the passageway adjacent to the primary fin, the secondary fin may have a curved flow surface that curves opposite to the flow surface of the primary fin. The secondary fin may be offset upstream or downstream from the primary fin.

9 Claims, 8 Drawing Sheets

| MOD # | FLANGE FINS | MIXER DP (PSI) | MIXER DP (IWC) | COV 3 L/D | COV 5 L/D | COV 10 L/D |
|---|---|---|---|---|---|---|
| 1 | 3″ DOWNSTREAM | 0.16 | 4.43 | 0.110 | 0.059 | 0.016 |
| 2 | 1-1/2″ DOWNSTREAM | 0.16 | 4.41 | 0.075 | 0.031 | 0.016 |
| 3 | 0″ DOWNSTREAM | 0.22 | 6.18 | 0.049 | 0.027 | 0.012 |
| 4 | 1″ UPSTREAM | 0.16 | 4.47 | 0.049 | 0.025 | 0.009 |
| 5 | 2″ UPSTREAM | 0.15 | 4.10 | 0.030 | 0.020 | 0.008 |
| 6 | 3″ UPSTREAM | 0.14 | 3.89 | 0.024 | 0.017 | 0.0086 |

FIG. 9

STATIC MIXER WITH CURVED FINS

RELATED APPLICATIONS

This application claims the benefit of priority to U.S. patent application Ser. No. 16/141,889 filed Sep. 25, 2018, entitled STATIC MIXER WITH CURVED FINS, which is incorporated herein by reference in its entirety.

TECHNICAL FIELD

The present patent documents relates generally to static mixing devices and more particularly to an improved static mixing device with curved fins.

BACKGROUND

Static mixers are mixers that have fixed position structural elements generally mounted within a length of pipe such that fluids passing through the pipe may be effectively mixed or blended with a wide variety of additives. Such mixers have widespread use such as in municipal and industrial water treatment, chemical blending and chlorination/de-chlorination facilities. A highly effective commercially available mixer of this general type is described in applicant's previous U.S. Pat. No. 8,147,124 issued Apr. 3, 2012 to Robert W. Glanville. The device disclosed in the '124 Patent operates in part by creating trailing vortices which produce effective mixing in the fluid stream. The teachings of U.S. Pat. No. 8,174,124 are hereby incorporated in its entirety into the present specification by specific reference thereto.

SUMMARY

Despite the availability of adequate mixing devices such as described in the above patent, there is a both a need and desire to achieve the same or better mixing outcome with lower head loss and to accomplish such in the shortest distance downstream from the mixing device. A further need in the art is the provision of such a device that accomplishes these objectives in a manner that is inexpensive, easy to fabricate from a wide variety of materials and operates in a trouble-free manner.

The static mixing device disclosed herein improves upon the prior art by providing a static mixer, including a tubular body with a number of fins projecting inwardly in the body. The tubular body has a sidewall with an upstream end, a downstream end opposite the upstream end, and an inner surface. The upstream end has a surface defining an upstream opening into the body. The downstream end has a surface defining a downstream opening exiting the body. The upstream opening, the downstream opening, and inner surface define a passageway through the body for transport of a first fluid therethrough. A primary fin may depend from the inner surface of the body and into the passageway. The primary fin may have a curved fin with a flow surface. A secondary fin may extend into the passageway adjacent to the primary fin, the secondary fin may have a curved flow surface that curves opposite to the flow surface of the primary fin. The secondary fin may be offset upstream or downstream from the primary fin.

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments, and are incorporated in and constitute a part of this specification, but are not intended as a definition of the limits of any particular embodiment. The figures, together with the remainder of the specification, serve only to explain principles and operations of the described and claimed aspects and embodiments, but are not to be construed as limiting embodiments. In the figures, each identical or nearly identical component that is illustrated in various figures is represented by a like numeral. For purposes of clarity, not every component may be labeled in every figure.

FIG. 9 is a chart of exemplary performance characteristics of the exemplary embodiments of static mixers illustrated in FIGS. 8A-8F.

DETAILED DESCRIPTION OF THE ILLUSTRATIVE EMBODIMENTS

The examples of the apparatus discussed herein are not limited in application to the details of construction and the arrangement of components set forth in the following description or illustrated in the accompanying drawings. It will be understood to one of skill in the art that the apparatus is capable of implementation in other embodiments and of being practiced or carried out in various ways. Examples of specific embodiments are provided herein for illustrative purposes only and are not intended to be limiting. Also, the phraseology and terminology used herein is for the purpose of description and should not be regarded as limiting. Any references to examples, embodiments, components, elements or acts of the apparatus herein referred to in the singular may also embrace embodiments including a plurality, and any references in plural to any embodiment, component, element or act herein may also embrace embodiments including only a singularity (or unitary structure). References in the singular or plural form are not intended to limit the presently disclosed apparatus, its components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Referring now to FIGS. 1-4, an embodiment of the static mixer according to the disclosure herein is shown generally at 10. The static mixer includes a tubular body 12 having a sidewall 14 with an inner surface 14*a* and outer surface 14*b*, an upstream end 14*c*, and a downstream end 14*d*. The body 12 has a diameter D as measured from the inner surface 14*a*. The upstream end 14*c* has a surface defining an opening into the body 12 and the downstream end 14*d* has a surface defining an exit from the body 12. The upstream opening, the downstream opening, and inner surface 14*a* on the sidewall 14 together, define a passageway through the body 12 for transport of a first fluid therethrough.

Figure 1:
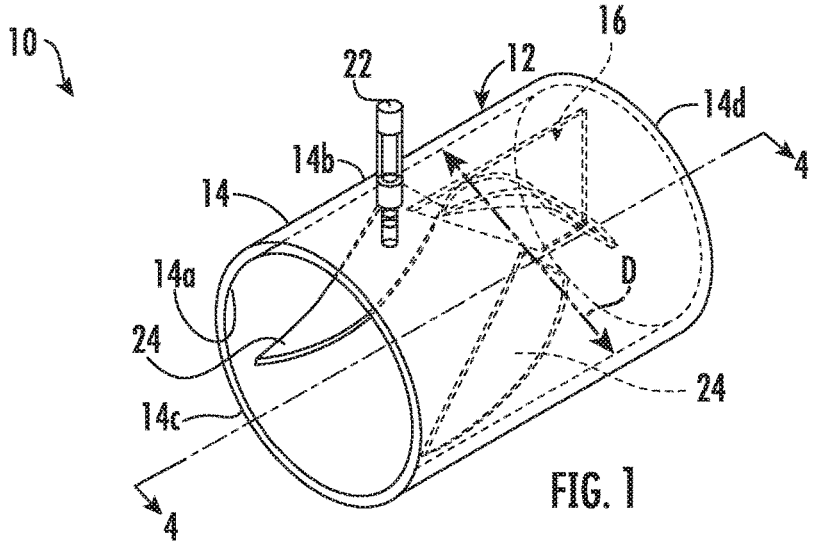
FIG. 1 is a perspective view of an embodiment of the static mixer according to the disclosure herein.
Figure 2:
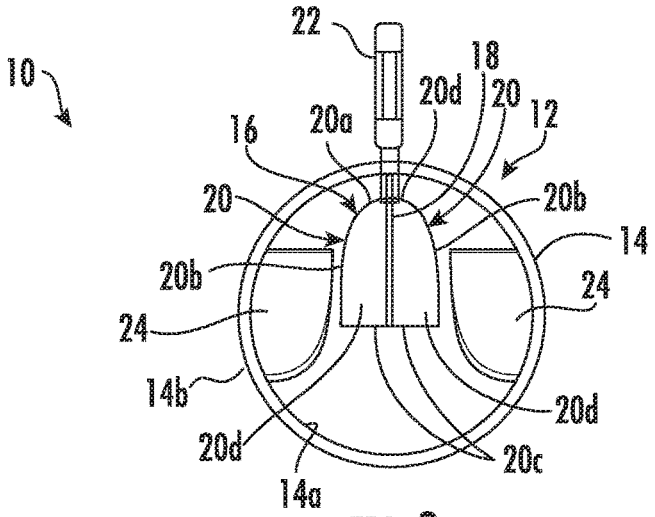
FIG. 2 is a front view thereof.
Figure 3:
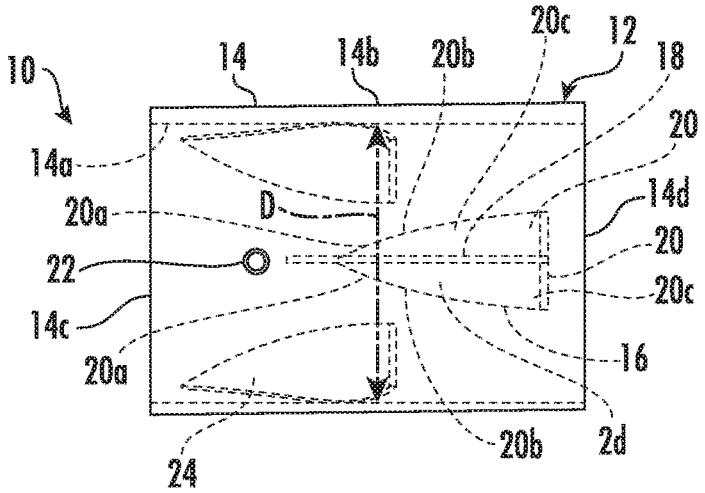
FIG. 3 is a top view thereof.
Figure 4:
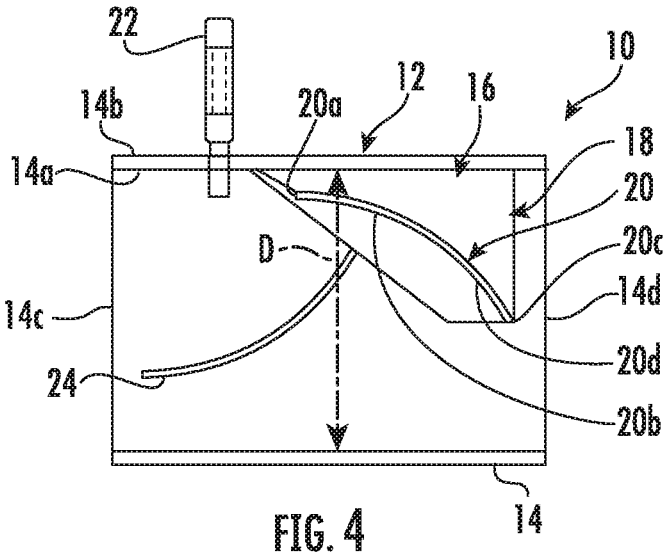
FIG. 4 is a partial side cross-section view through line 4-4 of FIG. 1.
Figure 5A:
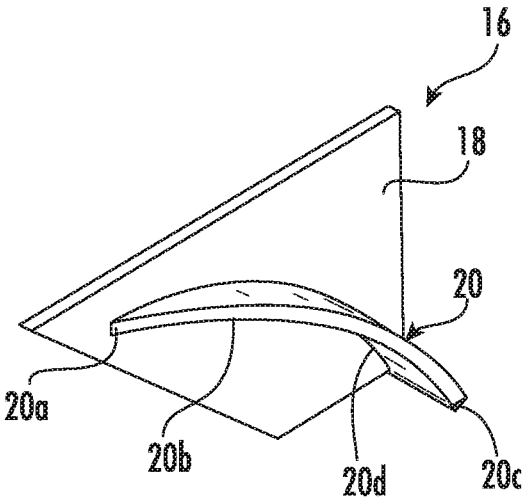
FIG. 5A is a perspective view of an embodiment of a primary fin of the static mixer according to the disclosure herein.
Figure 5B:
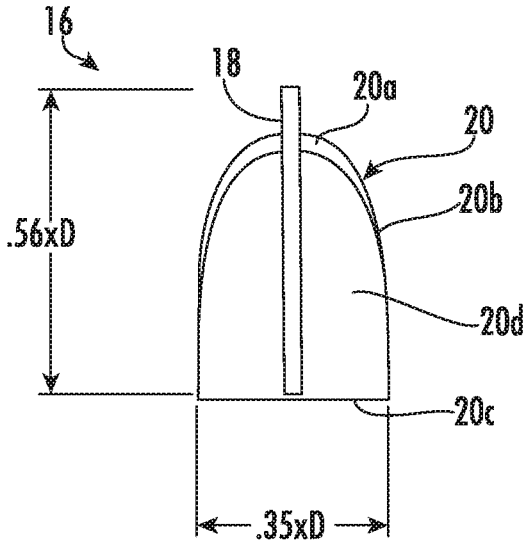
FIG. 5B is a front view of a primary fin illustrated in FIG. 5A.
Figure 5C:
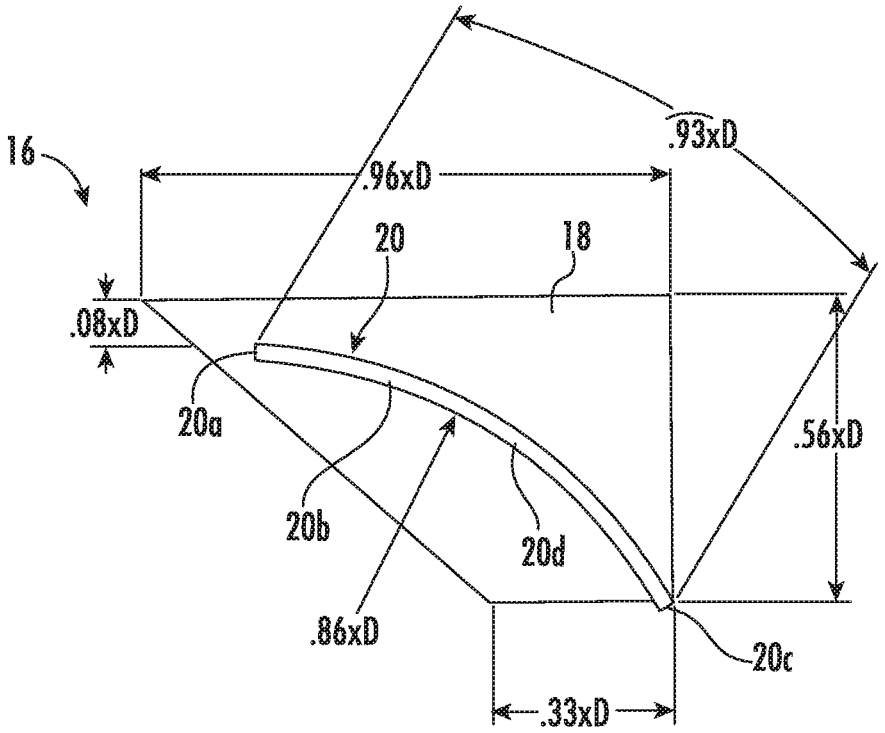
FIG. 5C is a right side view of a primary fin illustrated in FIGS. 5A and 5B.

In some embodiments, the static mixer 10 includes a primary fin 16 depending from the inner surface 14*a* of the sidewall 14 towards a central axis of the passageway, best seen in FIGS. 5A-5C. The primary fin 16 includes a spine 18 with a pair of curved fins 20 extending outwardly therefrom. The curved fins 20 each includes a tip 20*a*, a leading edge 20*b*, a trailing edge 20*c*, and a flow surface 20*d*. The curved fin 20 is connected to the spine 18 at a support edge of the curved fin 20. The flow surface 20*d* is defined between the tip 20*a*, the leading edge 20*b*, the trailing edge 20*c* and the support edge where the curved fin 20 joins the spine 18. The flow surface 20*d* of each curved fin 20 is curved in a direction away from the sidewall 14 where the spine 18 is joined, and/or towards the central axis. The tip 20*a* and leading edge 20*b* are positioned or pointed upstream from the trailing edge 20*c*, which is downstream from the tip 20*a* and leading edge 20*b*. As illustrated, the dimensions of the primary fin 16 may be sized and dimensioned according to ratios of the diameter D of the body 12. In one embodiment, the radius of curvature of the curved fins 20 is 0.86 the radius of the body 12. For instance, in an embodiment of the static mixer 10 configured for a ten inch pipe, the curved fins 20 may have a radius of about 8.6 inches. Similarly, other dimensions of the primary fin 16 may also be sized and dimensioned according to a ratio of the diameter D of the body 12. For instance, the height of the primary fin 16 may be 0.56D and the width 0.35D (best seen in FIG. 5B); the distance of the tip 20*a* of the curved fin 20 may be 0.08D from the inner surface 14*a* of the body 12 (best seen in FIG. 5C); the length of a bottom edge of the spine 18 may be 0.33D of the body 12; and the length of the curved fin 20, as measured on the surface opposite the flow surface 20*d*, may be 0.93D (best seen in FIG. 5C).

In some embodiments, a port 22 may for introduction of a second fluid may be positioned upstream from the primary fin 16. In some embodiments, the port 22 is aligned with the spine 18 of the primary fin 16.

Figure 6A:
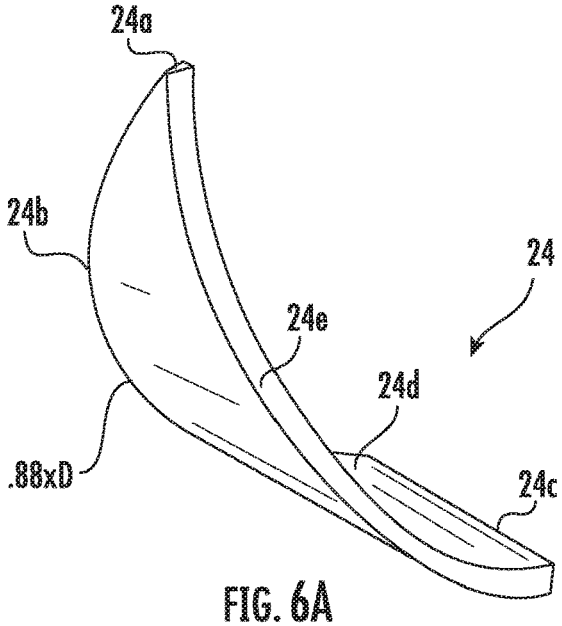
FIG. 6A is a perspective view of an embodiment of a secondary fin for a static mixer in accordance with the disclosure herein.
Figure 6B:
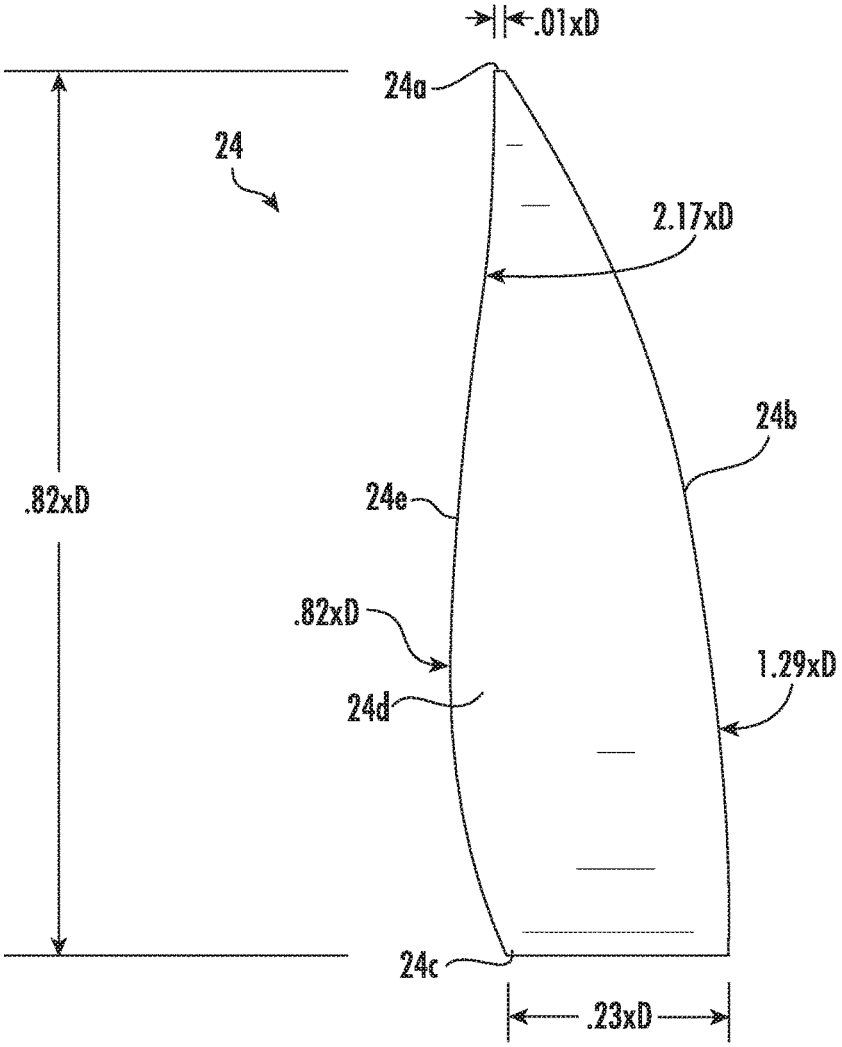
FIG. 6B is a top plan view of a secondary fin illustrated in FIG. 6B.

In some embodiments, the static mixer 10 includes a pair of secondary fins 24 extending inwardly from the sidewall 14. Referring to FIGS. 6A and 6B, an embodiment of a secondary fin 24 for a static mixer 10 in accordance with the disclosure herein is shown generally. Like the curved fins 20 on the spine 18 of the primary fin 20, each secondary fin 24 includes a tip 24*a*, a leading edge 24*b*, a trailing edge 24*c* and a flow surface 24*d*. Each secondary fin 24 further includes a support edge 24*e* which is connected to the side wall 14. The flow surface 24*d* is defined between the tip 24*a*, the leading edge 24*b*, the trailing edge 24*c* and the support edge 24*e* of the secondary fin 24. The flow surface 24*d* of each secondary fin 24 is curved in a direction opposite the curved fins 20 of the primary fin 16. For instance, the secondary fins 24 may curve toward the primary fin 16, and/or from the central axis. As illustrated, the dimensions of the secondary fin 24 may be sized and dimensioned according to ratios of the diameter D of the body 12. In one embodiment, the radius of curvature of the secondary fins 24 is 0.88 the radius of the body 12. For instance, in an embodiment of the static mixer 10 configured for a ten inch pipe, the secondary fins 24 may have a radius of about 8.8 inches. Similarly, other dimensions of the secondary fins 24 may also be sized and dimensioned according to a ratio of the diameter D of the body 12. For instance, the height of the secondary fin 16 may be 0.82D, the width of the trailing edge 24*c* may be 0.23D, and width of the tip 24*a* may be 0.01D (best seen in FIG. 6B). The curvature of the leading edge 24*b* may be a radius defined as 1.29D and the support edge 24*e* may have two curves, a first having a radius defined as 2.17D and a second having a radius defined as 0.82D.

Figure 7:
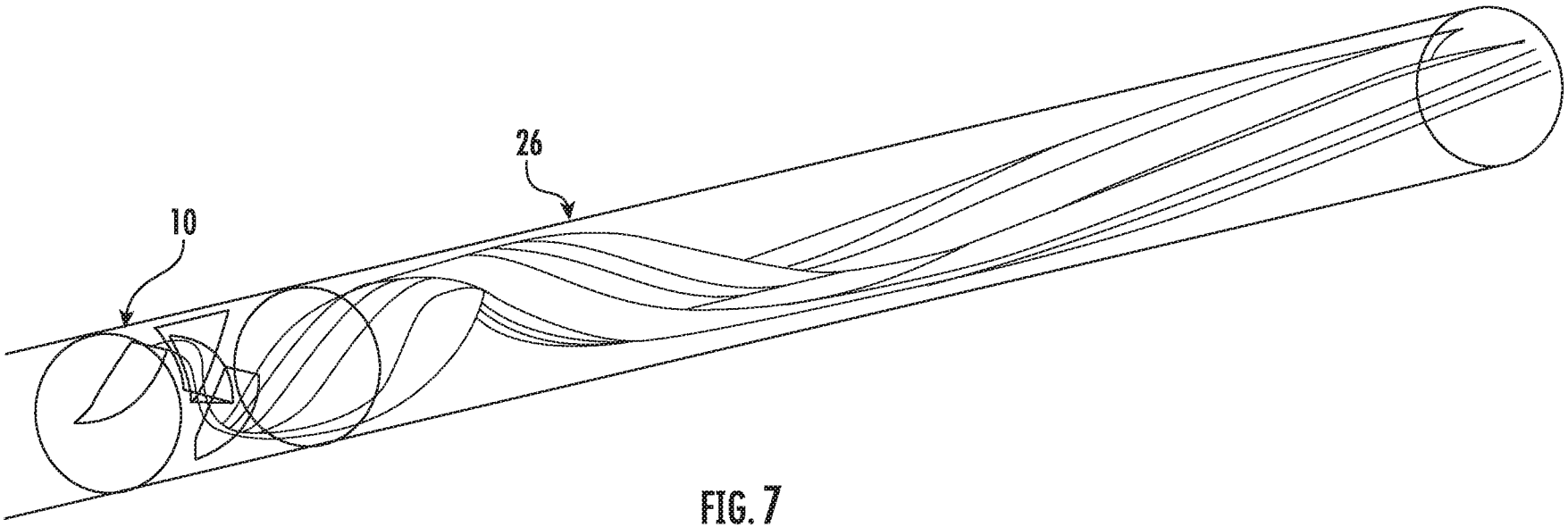
FIG. 7 is an illustration of an exemplary flow down a pipe from an embodiment of the static mixer in accordance with the disclosure herein.

As will be described in greater detail below, positioning of the secondary fins 24 upstream or downstream relative to the primary fin 16 may be used to increase mixing with decreased pressure loss. FIG. 7 is an illustration of an exemplary flow down a pipe 26 from an embodiment of the static mixer 10, where a first fluid introduced into the pipe 26 that travels through the passageway of the static mixer 10, mixes with a second fluid introduced through the port 22 of the stative mixer 10. Vortices created within the first fluid by the first fluid flowing in and around the secondary fins 24 and primary fin 16 thoroughly mix the first fluid and second fluid together with reduced pressure loss.

Figure 8A:
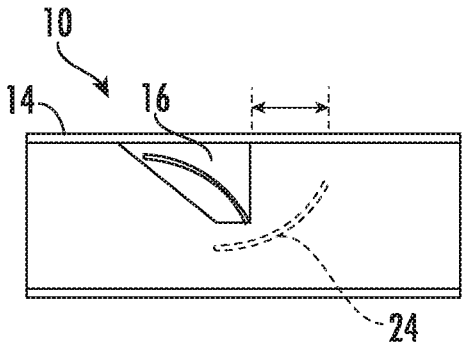
FIG. 8A is a side view illustration of an embodiment of a static mixer where the secondary fin is about three inches downstream from the primary fin.
Figure 8D:
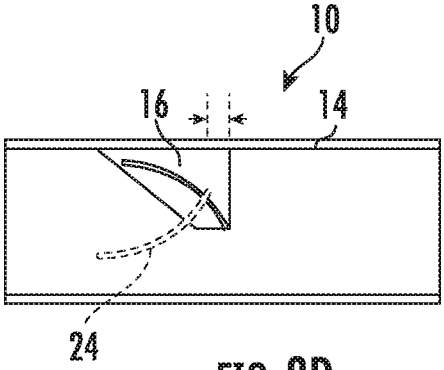
FIG. 8D is a side view illustration of an embodiment of a static mixer where the secondary fin is about one inch upstream from the primary fin.
Figure 8B:
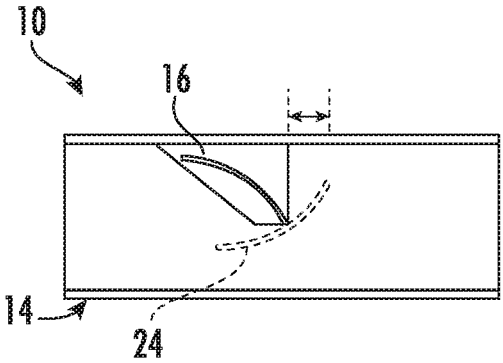
FIG. 8B is a side view illustration of an embodiment of a static mixer where the secondary fin is about one and one-half inches downstream from the primary fin.
Figure 8E:
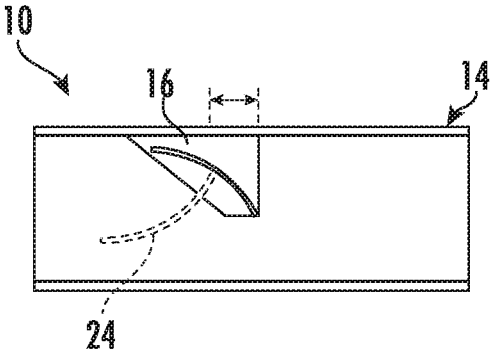
FIG. 8E is a side view illustration of an embodiment of a static mixer where the secondary fin is about two inches upstream from the primary fin.
Figure 8C:
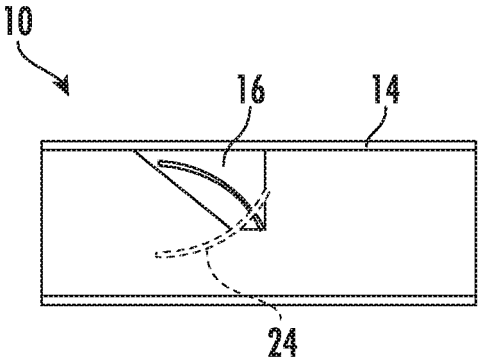
FIG. 8C is a side view illustration of an embodiment of a static mixer where the secondary fin is even with the primary fin, and neither upstream nor downstream therefrom.
Figure 8F:
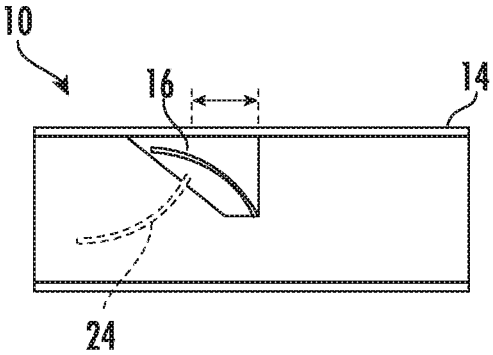
FIG. 8F is a side view illustration of an embodiment of a static mixer where the secondary fin is about three inches upstream from the primary fin.

Positioning of the secondary fins 24 relative to the primary fin 16 may take a number of configurations. For instance, in one embodiment best seen in FIG. 8A, the secondary fin 24 is positioned about three inches downstream from the primary fin 16 as measured from the trailing edges 20*c*, 24*c* of each fin 20, 24, respectively. FIG. 8B shows an embodiment where the secondary fin 24 is about one and one-half inches downstream from the primary fin 16 as measured from the trailing edges 20*c*, 24*c* of each fin 20, 24, respectively. FIG. 8C shows an embodiment where the secondary fin 24 is even with the primary fin 16, and neither upstream nor downstream as measured from the trailing edges 20*c*, 24*c* of each fin 20, 24, respectively. FIG. 8D shows an embodiment where the secondary fin 24 is about one inch upstream from the primary fin 16 as measured from the trailing edges 20*c*, 24*c* of each fin 20, 24, respectively. FIG. 8E shows an embodiment where the secondary fin 24 is about two inches upstream from the primary fin 16 as measured from the trailing edges 20*c*, 24*c* of each fin 20, 24, respectively. FIG. 8F shows an embodiment where the secondary fin 24 is about three inches upstream from the primary fin 16 as measured from the trailing edges 20*c*, 24*c* of each fin 20, 24, respectively.

Figure 10:
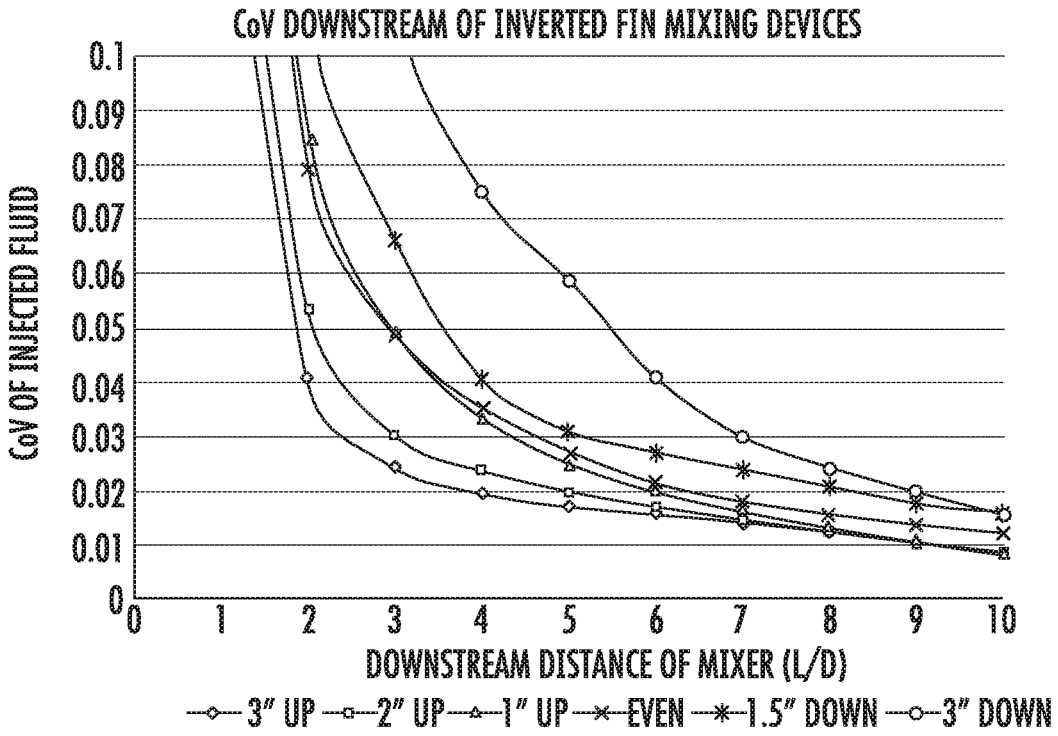
FIG. 10 chart of CoV versus distance downstream of the exemplary embodiments of the static mixers illustrated in FIGS. 8A-8F.

The objective of the static mixer 10 is to achieve a low CoV of the injected fluid within a short distance downstream of the injection point with as little pressure loss as possible. CFD tests were simulated to determine the head loss and mixing capabilities of the various embodiments of the static mixer 10 as illustrated in FIGS. 8A-8F, the static mixer 10 installed in a 6-inch pipe with water flowing at 360 gpm. FIG. 9 shows a chart of exemplary performance characteristics of the embodiments of static mixers illustrated in FIGS. 8A-8F. FIG. 10 shows a chart of coefficient of variation (CoV) versus distance downstream of the exemplary embodiments of the static mixers illustrated in FIGS. 8A-8F. As can be ascertained from the charts, the embodiment illustrated in FIG. 8F exhibited the best performance characteristics with best mixing with least pressure loss, with the pressure loss coefficient (K) was 1.26 and the CoV values were 0.024, 0.017 and 0.0086 at 3 L.D, 5 L/D and 10 L/D, respectively.

Accordingly, the static mixer disclosed herein represents a significant improvement over prior by providing a static mixer that uniquely solves the problems of providing a superior mixing action to two fluids with minimal pressure head loss downstream of the injection site.

Those skilled in the art will appreciate that the conception, upon which this disclosure is based, may readily be utilized as a basis for designing other products without departing from the spirit and scope of the invention as defined by the appended claims. Therefore, the claims are not to be limited to the specific examples depicted herein. For example, the features of one example disclosed above can be used with the features of another example. Furthermore, various modifications and rearrangements of the parts may be made without departing from the spirit and scope of the underlying inventive concept. For example, the geometric configurations disclosed herein may be altered depending upon the application, as may the material selection for the components. Thus, the details of these components as set forth in the above-described examples, should not limit the scope of the claims.

What is claimed is:

1. A static mixer, comprising:

a tubular body having a sidewall with an upstream end, a downstream end opposite the upstream end, and an inner surface;

a passageway extending between the upstream end and the downstream end constructed and arranged to transport a first fluid therethrough and including a central axis;

a primary fin comprising:

a spine supported on the inner surface of the sidewall and extending into the passageway towards the central axis and including a first side and a second side opposite the first side;

a first fin and a second fin each comprising:

a support edge disposed on opposite sides of the spine;

a tip;

a leading edge;

a trailing edge; and a curved flow surface that curves away from the sidewall;

wherein the first fin and the second fin are positioned on the spine so that the leading edge is positioned upstream from the trailing edge; and a secondary fin extending into the passageway, the secondary fin having a leading edge and a trailing edge and a curved flow surface, wherein the flow surface of the secondary fin curves opposite to the flow surface of the primary fin.

2. The static mixer of claim 1, wherein the leading edge of the secondary fin is tapered inwardly toward the inner surface of the sidewall of the tubular body.

3. The static mixer of claim 2, wherein the leading edge of the secondary fin is tapered to the sidewall in the upstream direction.

4. The static mixer of claim 1, wherein the trailing edge of the secondary fin is offset from the trailing edge of the primary fin downstream therefrom.

5. The static mixer of claim 1, wherein the trailing edge of the secondary fin is offset from the trailing edge of the primary fin upstream therefrom.

6. The static mixer of claim 1, wherein the trailing edge of the secondary fin and the trailing edge of the primary fin are not offset from one another.

7. The static mixer of claim 1, wherein the trailing edge of the secondary fin is offset from the trailing edge of the primary fin from about three inches downstream to about three inches upstream therefrom.

8. The static mixer of claim 1, further comprising a port configured and arranged for introduction of a second fluid into the passageway of the body for mixing with the first fluid.

9. The static mixer of claim 8, wherein the port is upstream from the primary fin.

* * * * *